US006925673B2

(12) United States Patent
Sartori

(10) Patent No.: US 6,925,673 B2
(45) Date of Patent: Aug. 9, 2005

(54) CLEANING ELEMENT FOR BROOMS OR BRUSHES

(76) Inventor: Francesco Sartori, Via San Felice, 44-40122 Bologna (IT)

( * ) Notice: Subject to any disclaimer, the term of this patent is extended or adjusted under 35 U.S.C. 154(b) by 39 days.

(21) Appl. No.: 10/466,924

(22) PCT Filed: Aug. 5, 2002

(86) PCT No.: PCT/IB02/03094

§ 371 (c)(1),
(2), (4) Date: Jul. 21, 2003

(87) PCT Pub. No.: WO03/026460

PCT Pub. Date: Apr. 3, 2003

(65) Prior Publication Data

US 2004/0055100 A1 Mar. 25, 2004

(30) Foreign Application Priority Data

Sep. 21, 2001 (IT) ..... BO2001A0578

(51) Int. Cl.[7] ..... A46B 3/00

(52) U.S. Cl. ..... 15/191.1; 15/159.1; 15/171; 15/190; 15/194; 15/199; 15/202

(58) Field of Search ..... 15/194, 202, 191.1, 15/195, 196, 199, 159.1, 171, 190; 300/21

(56) References Cited

U.S. PATENT DOCUMENTS

| | | | | | |
|---|---|---|---|---|---|
| 2,130,244 | A | * | 9/1938 | Nishio | 300/21 |
| 4,302,863 | A | * | 12/1981 | Droeser | 15/183 |
| 5,378,051 | A | * | 1/1995 | Kirkkala et al. | 300/21 |
| 6,779,851 | B2 | * | 8/2004 | Bouchiere | 300/21 |

FOREIGN PATENT DOCUMENTS

| | | |
|---|---|---|
| CH | 617 088 | 5/1980 |
| DE | 602 088 | 8/1934 |
| FR | 1286767 | 3/1962 |
| GB | 203797 | 9/1923 |

* cited by examiner

*Primary Examiner*—John Kim
*Assistant Examiner*—S Balsis
(74) *Attorney, Agent, or Firm*—Pearne & Gordon LLP

(57) ABSTRACT

A cleaning element (1) for brooms or brushes comprises a board (2) having a surface (3) for supporting a plurality of clusters or bundles (4) of fibres forming a cleaning body (5); each cluster (4) is provided with a related element (6) for fastening the clusters (4) to the surface (3) and it can be associated to the board (2); the latter has at least an internal cavity (7) for housing the fastening elements (6) in correspondence with their passage through related through holes (8) provided in the support surface (3).

11 Claims, 1 Drawing Sheet

CLEANING ELEMENT FOR BROOMS OR BRUSHES

This application claims the benefit of International Application Number PCT/IB02/03094, which was published in English on Apr. 3, 2003.

TECHNICAL FIELD

The present invention relates to a cleaning element for brooms or brushes.

BACKGROUND ART

Currently, known brooms or brushes comprise a board for supporting a cleaning body defined by a plurality of clusters or bundles of fibres, usually bristles, engaged in related holes obtained in the board on the side opposite the one in which a grip handle is associated to the board.

The cleaning body has its clusters or bundles of fibres with their free ends aligned on a plane parallel to the side in which the engagement holes are obtained, and it laterally exhibits a perpendicular or angled profile relative to the board.

The support board, of various shapes, is usually obtained by moulding synthetic material and then machining it, i.e. holing it on the surface destined to define the area of association of the bristle clusters.

Each of said blind holes, obtained on the latter surface, defines a housing seat for an individual cluster of bristles mutually bent back and held by a fastening element, usually made of metal. This fastening element is thrust inside each hole, together with a part of the cluster, in order to determine a penetration of the element into the board and with the consequent partial deformation inside the hole so as to obtain a locking of the cluster in correspondence with the surface of the board.

This solution of the cleaning element, however, entails a drawback given, in particular, by the possible presence of air bubbles inside the board, generated during the moulding cycle, which bubbles, if present in proximity to the blind holes, could cause a defective application of the fastening element during bristle insertion, or even a partial or total collapse of the element itself, thereby creating a discontinuity of the cleaning surface. In addition, to overcome this drawback, board shapes have to be used that will allow for an easy moulding of the board or in any case for taking into account the effects deriving from the moulding operation itself.

DISCLOSURE OF THE INVENTION

The aim of the present invention, therefore, is to eliminate the aforementioned drawback by providing a cleaning element for brooms or brushes that is compact, practical and with a constructive architecture that is more rational and secure in the mounting and holding of the bristle clusters.

The aforementioned aim is reached by means of a cleaning element for brooms or brushes comprising a board having a surface for supporting a plurality of clusters or bundles of fibres forming a cleaning body; each cluster is provided with a related element for fastening the clusters to the surface, which can be associated to the board; the latter has an internal cavity for housing the fastening elements in correspondence with their passage through related through holes, obtained in the support surface.

BRIEF DESCRIPTION OF THE DRAWINGS

The technical characteristics of the invention, according to the aforesaid aims, can clearly be noted from the content of the claims set out below and its advantages shall become more readily apparent in the detailed description that follows, made with reference to the accompanying drawings, which represent an embodiment provided purely by way of non limiting example, in which:

DETAILED DESCRIPTION OF THE PREFERRED EMBODIMENTS OF THE INVENTION

Figure 1:
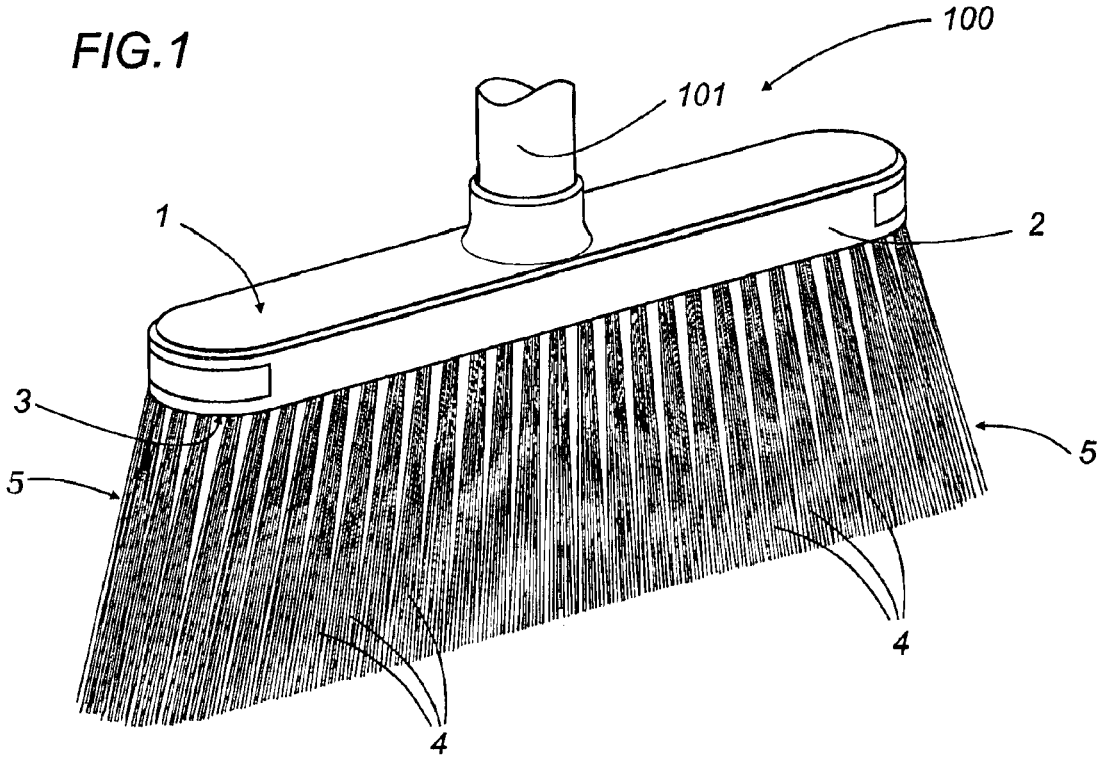
FIG. 1 shows prospective schematic view of a broom which can be obtained with a cleaning element in accordance with the present invention, with some parts removed the better to highlight others.

In accordance with the figures of the accompanying drawings, and with particular reference to FIG. 1, the cleaning element of the present invention is used to obtain brooms or brushes for cleaning surfaces.

FIG. 1 shows, purely by way of example, a broom (indicated with the reference number 100) comprising a grip handle 101 and the cleaning element 1, which comprises a board 2 having a surface 3 for supporting a plurality of clusters or bundles 4 of fibres forming a cleaning body 5 and provided, each, with a related element 6 for fastening the clusters 4 to the surface 3, which element 6 can be associated to the board 2.

In practice, the fastening element 6, known in itself, is constituted by an open ring, which can, purely by way of non limiting example, be made of metal, whereon the bristles are fastened, bent back on themselves, to define a cluster 4.

Figure 2:
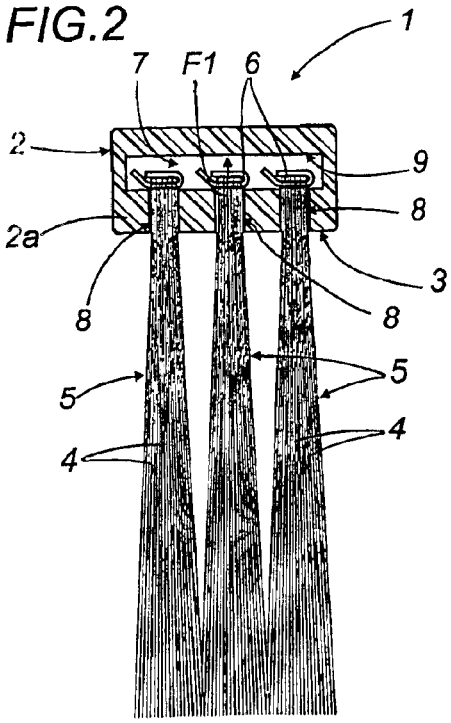
FIG. 2 shows a front view, with some parts sectioned, of a first embodiment of the cleaning element of the present invention.

The aforesaid board 2 (see in particular FIGS. 2 and 3) has at least an internal cavity 7 for housing the aforementioned fastening elements 6 in correspondence with their passage through related through holes 8 obtained in the aforesaid support surface 3.

In particular, if the open ring 6 is used, the internal cavity 7 of the board 2 is provided with an abutting surface 9 for the fastening elements 6, housed in the same cavity 7, in such a way as to allow a deformation of the fastening elements 6 and cause the locking of the aforesaid clusters 4 on the board 2.

More specifically, the cavity 7 present inside the aforesaid board 2 has, preferably but not exclusively, regular development and cross section in order to allow a constant and optimal insertion and deformation for each aforementioned fastening element 6: this is aimed at ensuring that all the clusters 4 on the cleaning body 1 are securely fastened.

At the constructive level, the aforementioned board 2 can be constituted by a solid body 2*a*, for instance made of plastic moulding material, whereon is obtained, according to known technologies, the aforementioned internal cavity 7 with regular and rectangular section (see FIG. 3) and defining at least two main surfaces 3 and 9, which are parallel and mutually opposite: the first such surface, indicated with the reference number 3, constitutes the access area of the aforesaid fastening elements 6 and of the related clusters 4, and having the plurality of the aforementioned holes 8, whilst the other surface 9 defines a regular abutment area for the deformation of the fastening elements 6.

Purely by way of example, the board 2 shown herein has a single cavity, but it could also be constructed with two or more distinct cavities 7 inside the body 2*a* according to the construction requirements of the broom or brush, without thereby limiting the scope of protection of the present invention.

Figure 3:
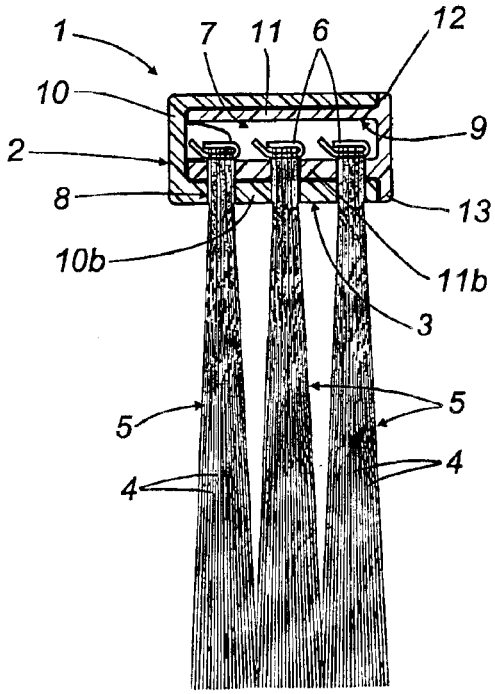
FIG. 3 shows a front view of a second embodiment of the cleaning element of the present invention, with some parts sectioned the better to highlight other parts.

As shown in FIG. 3, the aforesaid board 2 can be constituted by two bodies 10 and 11, which can also be obtained by moulding and made of plastic material, able to be inserted within each other and constituting, once the assembly operation is complete, the aforesaid cavity 7 defining the two main parallel and opposite surfaces 3 and 9.

In this solution as well, the first surface indicated with the reference number 3 constitutes the access surface or area of the fastening elements 6 and of the clusters 4, having a plurality of holes 8, whilst the other surface 9 defines an abutment for the deformation of the fastening elements 6.

The aforesaid first body 10 has its cross section shaped as a "U" rotated on one side and defines, in practice, the external portion of the board 2 for three sides thereof.

The second body 11 has its cross section shaped as a "U" rotated on one side and able to be stably inserted, for instance by forcing or by snapping, inside the first body 10 in such a way as to define the aforementioned internal cavity 7 with regular development.

In particular, the second body 11 can be provided with at least a fin or, preferentially, two fins 12 and 13, projecting from its own closed side 11*a*, and defining an abutment on the free ends of the aforesaid first body 10, once the assembly operation is completed, in such a way as to define a uniform outer perimeter of the board 2.

In the case illustrated above, the two parallel and contiguous sides 10*b* and 11*b* of the two bodies 10 and 11 are provided, once the assembly operation is completed, with coaxial holes 8 for the passage of the fastening elements 6 inside the cavity 7.

In practice, the board 2 described above is obtained by defining a body 2*a* or two bodies 10 and 11, as described previously, and constituting the board 2, having said internal cavity 7. Subsequently, the through holes 8 are obtained in the support surface 3 in such a way as to connect the aforementioned cavity 7 with the exterior.

At this point the aforementioned fastening elements 6, which join the clusters 4, are housed in the cavity 7 by forcing their passage in the holes 8 (see arrow F1 in FIG. 2); the fastening elements 6 are then deformed by abutting them against the aforementioned upper and regular surface 9 of the cavity 7 in such a way as to lock the fastening element 6 inside the cavity 7, since the size of the fastening element 6 is, at this point, greater than the diameter of the hole 8.

A cleaning element thus obtained allows to construct extremely practical brooms or brushes, with similar characteristics to traditional elements, but with considerable advantages.

The first advantage is provided by the reduced weight of the element, thanks to the presence of the central cavity, and by a consequent faster moulding cycle.

The presence of the cavity determines a more secure and constant application of the bristle clusters with the fastening element thanks to the definition of a regular abutting surface where the fastening elements are deformed in constant fashion, thereby securing the plurality of clusters on the board in an excellent manner and hence obtaining a regular and precise cleaning surface of the broom or brush.

The invention thus conceived can be subject to numerous modifications and variations, without thereby departing from the scope of the inventive concept. Moreover, all components can be replaced with technically equivalent elements.

What is claimed is:

1. Cleaning element for brooms or brushes, element (1) comprising a board (2) having a surface (3) for supporting a plurality of clusters or bundles (4) of fibres forming a cleaning body (5) and provided, each, with a related element (6) for fastening the clusters (4) to said surface (3) and able to be associated to said board (2), said board (2) having one internal cavity (7) for housing said fastening elements (6) in correspondence with their passage through related through holes (8), obtained in said support surface (3); wherein said board (2) is constituted by at least two bodies (10, 11) able to be inserted in each other along a direction perpendicular to the longitudinal extension of said through holes (8) and realizing, once the assembly operation is completed, said cavity (7) defining at least two main surfaces (3, 9), parallel and opposite, whereof one (3) constitutes the access area of said fastening elements (6) and of said clusters (4), having a plurality of said holes (8), and the other surface (9) defining an abutment area for deforming said fastening elements (6).

2. Element as claimed in claim 1, characterized in that said board (2) has at least said internal cavity (7) provided with an abutment surface (9) for said fastening elements (6), housed in said cavity (7), in such a way as to allow a deformation of said fastening elements (6) and thereby obtain a fastening of said clusters (4) on said board (2).

3. Element as claimed in claim 2, characterized in that said board (2) has at least an internal cavity (7) with regular development and cross section.

4. Element as claimed in claim 2, characterized in that said board (2) has at least an internal cavity (7) with regular development and cross section able to allow a constant insertion and deformation of each said fastening element (6).

5. Element as claimed in claim 1, characterized in that said board (2) has at least an internal cavity (7) with regular development and cross section.

6. Element as claimed in claim 1, characterized in that said board (2) has at least an internal cavity (7) with regular development and cross section able to allow a constant insertion and deformation of each said fastening element (6).

7. Element as claimed in claim 1, characterized in that said first body (10) has a cross section shaped as a "U" rotated on one side and defines the outer portion of said board (2) for three sides thereof.

8. Element as claimed in claim 7, characterized in that two parallel and contiguous sides (10*b*, 11*b*) of said two bodies (10, 11) are provided, once the assembly operation is completed, with coaxial holes (8) for the passage of said fastening elements (6) inside said cavity (7).

9. Element as claimed in claim 1, characterized in that said second body (11) has a cross section shaped as "U" rotated on one side and able to be stably inserted inside said first body (10) in such a way as to define said internal cavity (7) with regular development.

10. Element as claimed in claim 9, characterized in that said second body (11) is provided with at least a fin (12) projecting from its own closed side (11*a*) and defining an abutment on free ends of said first body (10), once the assembly operation is completed, in such a way as to define a uniform external perimeter of said board (2).

11. Element as claimed in claim 9, characterized in that said second body (11) is provided with at least a pair of fins (12, 13) projecting from its own closed side (11*a*) and defining an abutment on free ends of said first body (10), once the assembly operation is completed, in such a way as to define a uniform external perimeter of said board (2).

* * * * *